United States Patent [19]

Beckey

[11] Patent Number: 4,790,142

[45] Date of Patent: Dec. 13, 1988

[54] METHOD FOR MINIMIZING CYCLING LOSSES OF A REFRIGERATION SYSTEM AND AN APPARATUS USING THE METHOD

[75] Inventor: Thomas J. Beckey, Edina, Minn.

[73] Assignee: Honeywell Inc., Minneapolis, Minn.

[21] Appl. No.: 87,114

[22] Filed: Aug. 19, 1987

[51] Int. Cl.[4] ..... F25B 13/00

[52] U.S. Cl. ..... 62/115; 62/160; 62/231

[58] Field of Search ..... 62/160, 231, 324.6, 62/81, 115, 196.3, 158

[56] References Cited

U.S. PATENT DOCUMENTS 4,137,725 2/1979 Martin ..... 62/160

4,576,011 3/1986 Glamm et al. ..... 62/324.6 X

*Primary Examiner*—William E. Wayner

*Attorney, Agent, or Firm*—Mitchell J. Halista; Albin Medved; Clyde C. Blinn

[57] ABSTRACT

A refrigeration system control for minimizing cycling losses of a refrigeration system having an indoor coil, an indoor coil fan, an outdoor coil, an outdoor coil fan, a refrigerant line between one end of the indoor coil and one end of the outdoor coil, a compressor apparatus and a reversing valve connecting the compressor apparatus between the other end of the indoor coil and the other end of the outdoor coil includes the steps of operating the reversing valve to a state opposite to the one representative of the operating condition of the refrigeration system for a predetermined period of time starting prior to an energization of the compressor apparatus and ending after the energization of the compressor apparatus, restoring the reversing valve to a state needed for the operating condition of the refrigeration system at the end of the period of time while continuing the energization of the compressor apparatus.

12 Claims, 2 Drawing Sheets

METHOD FOR MINIMIZING CYCLING LOSSES OF A REFRIGERATION SYSTEM AND AN APPARATUS USING THE METHOD

CROSS-REFERENCE TO CO-PENDING APPLICATION

Subject matter shown but not claimed herein is shown and claimed in a co-pending application of T. J. Beckey and Lorne W. Nelson, Ser. No. 050,270, now U.S. Pat. No. 4,750,672, filed on May 15, 1987.

BACKGROUND OF THE INVENTION

Field of the Invention

The present invention relates to a refrigeration system. More specifically, the present invention is directed to a control method for a refrigeration system for minimizing cycling losses and an apparatus using the method.

SUMMARY OF THE INVENTION

An object of the present invention is to provide an improved refrigeration system control method to minimize cycling losses.

Another object of the present invention is to provide an improved refrigeration system utilizing the improved control method.

In accomplishing these and other objects, there has been provided, in accordance with the present invention a method for controlling a refrigeration system, an indoor coil, an indoor coil fan, an outdoor coil, an outdoor coil fan, a refrigerant line between one end of the indoor coil and one end of the outdoor coil, a compressor apparatus and a reversing valve connecting the compressor means between the other end of the indoor coil and the other end of the outdoor coil including the steps of operating the reversing valve to a state opposite to the one representative of the operating condition of the refrigeration system for a predetermined period of time starting prior to an energization of the compressor apparatus and ending after the energization of the compressor apparatus, restoring the reversing valve to a state needed for the operating condition of the refrigeration system at the end of the period of time while continuing the energization of the compressor apparatus. An apparatus utilizing this method in a refrigeration system comprises an indoor coil, an indoor coil fan, an outdoor coil, an outdoor coil fan, a refrigerant line connecting one end of the indoor coil to one end of the outdoor coil, a compressor apparatus, a reversing valve connecting the compressor apparatus between the other end of the indoor coil to the other end of the outdoor coil and a controller means for operating the valve, the indoor fan, the outdoor fan and the compressor means in a sequence which includes operating the reversing valve to a state opposite to the one representative of the operating condition of the refrigeration system for a predetermined period of time starting prior to an energization of the compressor apparatus and ending after the energization of the compressor apparatus, restoring the reversing valve to a state needed for the operating condition of the refrigeration system at the end of the period of time while continuing the energization of the compressor apparatus.

BRIEF DESCRIPTION OF THE DRAWING

A better understanding of the present invention may be had when the following detailed description is read in connection with the accompanying drawings in which.

DESCRIPTION OF THE PREFERRED EMBODIMENT

Figure 1:
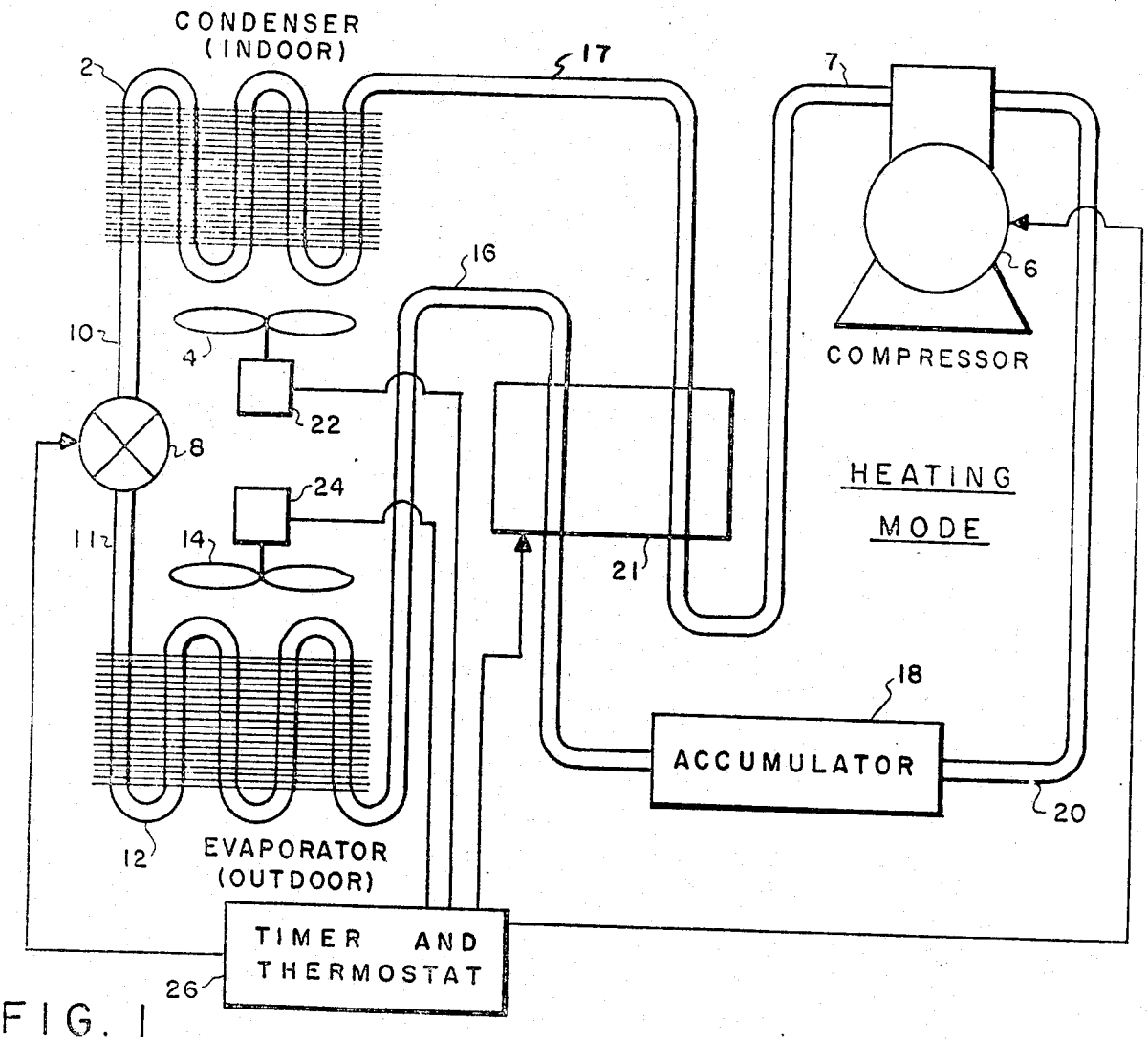
FIG. 1 is a simplified pictorial illustration of a refrigeration system in a heating mode and incorporating an example of the present invention and FIG. 2 is a simplified pictorial illustration of the refrigeration system shown in FIG. 1 in a cooling mode and utilizing the present invention.

Referring to FIG. 1 in more detail, there is shown a simplified pictorial illustration of a refrigeration system arranged in a heating mode having an indoor coil identified as a condenser coil 2 and an indoor coil fan 4. These elements are conventionally referred to as indoor elements inasmuch as they are located within the enclosure or space to be heated by the flow of indoor air over the condenser 2 during heating mode of operation. In a cooling mode of operation, the flow of refrigerant is reversed by a four-way reversing valve as described hereinafter, and the indoor coil unit is used as an evaporator coil to cool the flow of air within the conditioned space or enclosure. The outdoor coil would concurrently function as a condenser coil. The present invention is applicable to either mode of operation. An apparatus utilizing both types of operation with a reversing valve to selectively switch from one mode of operation to the other is conventionally designated as a heat pump, e.g., the system shown in U.S. Pat. No. 3,115,018. A compressor 6 is used to supply a compressed refrigerant along a first refrigerant line 7 to an inlet of the condenser 2. An electrically operated tight shutoff valve 8 in a second refrigerant line 10 connected to the outlet of the condenser 2 is selectively used to control the flow of refrigerant from the condenser 2. The outlet from the valve 8 is connected through a third line 11 to an inlet of an outdoor coil 12 having a fan 14 associated therewith. Since these elements are arranged externally of the enclosure to be heated during the heating mode of operation they are referred to as outdoor elements.

Figure 2:
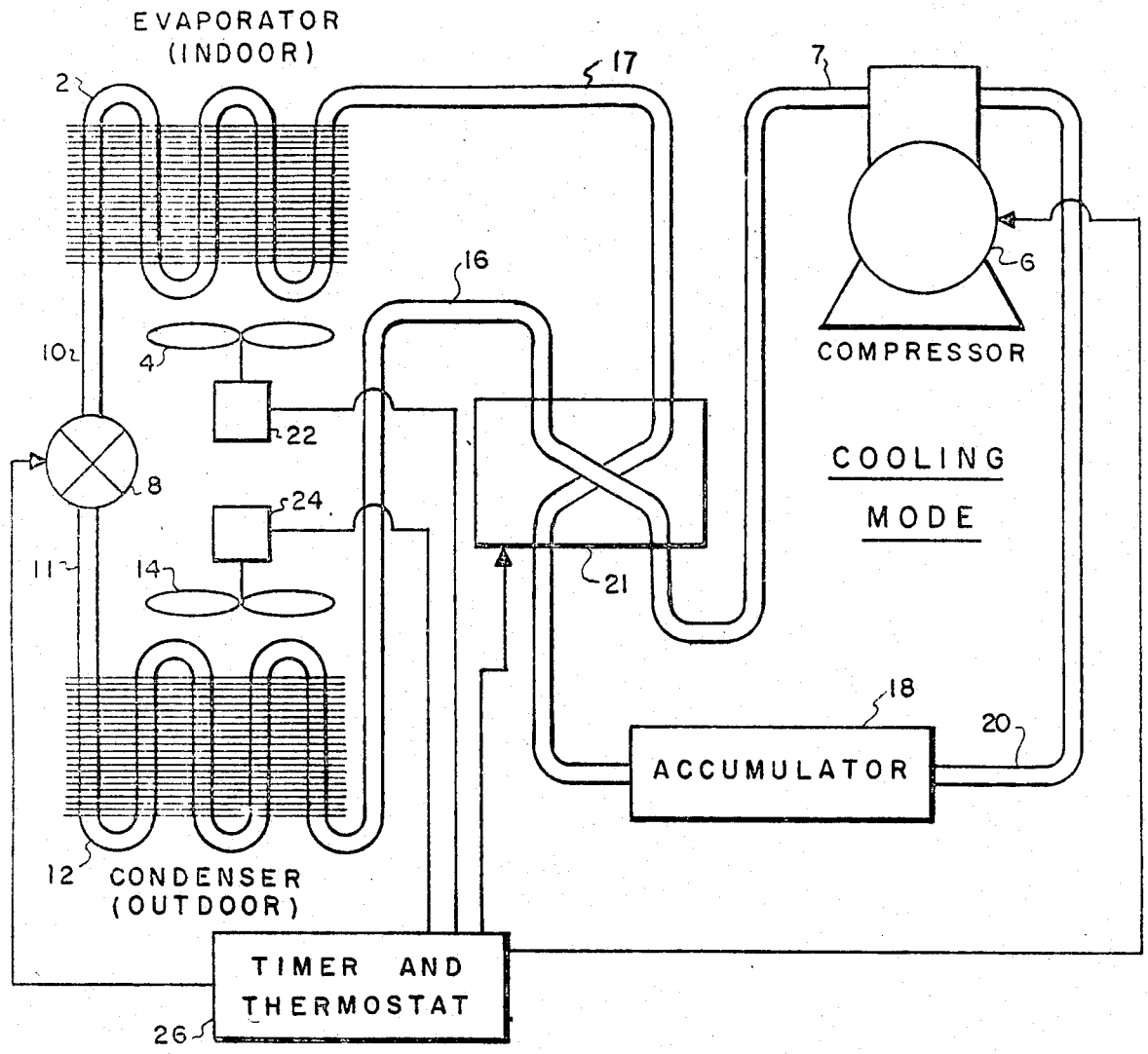

The output from the evaporator 12 is connected through a fourth line 16 to an input of a refrigerant accumulator 18. An output from the accumulator 18 is connected through a fifth line 20 to the inlet of the compressor 6. A four-way reversing valve 21 is arranged in the flow lines 7 and 16 to change the refrigerant flow between the heating and cooling modes as shown in FIGS. 1 and 2, respectively. The operation of such reversing valves is well-known in the art as discussed in the aforesaid patent and basically provides a reversal of the functions of the indoor and outdoor coils 2,12 to provide the heating and cooling modes. A motor 22 for the condenser fan 4, a motor 24 for the evaporator fan 14, the valve 8 and the compressor 6 are operated in a sequential pattern by a timer and thermostat controller 26. While such multiple time sequence timers are well-known in the art, the timing sequences used in the present invention to achieve the novel method of the present invention can also be obtained from a microprocessor operated according to a fixed program stored in a memory. The operation of a microprocessor and the storage of a program to operate a microprocessor are well-known operations to one skilled in the art and require no further explanation for a complete understanding of the present invention.

During steady state operation in the heating mode, most of the system's refrigerant resides in the condenser 2 and line 10 as a hot liquid. Since the valves ordinarily used in the refrigeration system do not shut tightly when the compressor is turned off, the refrigerant will migrate from the condenser and line 10 to the evaporator. The heat energy in the refrigerant is, consequently, lost to the outdoor air by means of the evaporator coil. Also, the energy stored in the mass of the hot condenser coil may be lost if the condenser coil is located in an unconditioned space. Further, because the excess refrigerant in the evaporator has to be pumped back into the condenser when the compressor starts, the time to reach steady state is increased. Both of these effects result in a degradation of the cyclic coefficient of performance (COP) of the system.

In order to minimize such losses, the system shown in FIG. 1 is arranged to close the valve 8 immediately after the compressor 6 is turned off to provide a tight shut-off of line 10 in order to contain the hot liquid refrigerant in the condenser or indoor coil 2 and line 10. Concurrently, the indoor fan 4 is allowed to continue running for a predetermined first period of time as determined by the timer 26 to capture the heat energy stored in the hot coil and refrigerant of the condenser. At the end of the first time period, the fan for the condenser 2 is turned off.

In order to start at the beginning of the next cycle, the timer 26 is arranged to operate the reversing valve 21 for a fixed period of time to the opposite state from that used in the current operating condition of the refrigeration system prior to and during a start-up of the compressor 6. Thus, if the system is in a heating mode of operation as shown in FIG. 1, the reversing valve 21 would be operated by the time 26 to the valve state shown in FIG. 2 for a fixed period of time and returned to the state shown in FIG. 1 at the end of the time period which period starts prior to a start-up of the compressor 6 and continues during an initial energization of the compressor 6. This momentary operation of the reversing valve 21, e.g., one to two seconds, would be effective to reduce the pressure difference across the compressor 6 to substantially zero, i.e., the reversal is not intended to redistribute the liquid refrigerant but to redistribute the pressure. During the momentary reversal of the reversing valve 21, the compressor 6 would be energized and would reach its operating RPM under a no-load condition.

At the expiration of the fixed period of time, the reversing valve 21 is returned to its former state corresponding to the operating condition of the refrigeration system. At this time, the motor driving the compressor 6 has attained a torque characteristic suitable for coping with the load increase of the pressure difference present across the compressor 6 following the return of the reversing valve 21. Thus, prior to the reversal of the valve 21, the compressor outlet line 7 and the indoor coil inlet line 17 contain all vapor under a high pressure while the compressor inlet line 20 and the outdoor coil outlet line 16 contain a low pressure vapor whereby a high pressure differential exists across the compressor 6. During the momentary reversal of valve 21, the flow through the compressor 6 is reversed to reverse the pressure difference so that the compressor outlet line 7 now has a low pressure which enables the compressor 6 to start against a negative pressure difference. Since only vapor leaves the condenser 2, the momentary reversal does not produce a movement of excessive refrigerant from the condenser 1 to the evaporator 12. During the cooling mode of operation of the refrigeration system, the opposite type of momentary switching of the reversing valve 21, i.e., from FIG. 2 to FIG. 1, is used.

If the frequent switching of the reversing valve 21 is undesired to avoid excessive wear, an alternate structure can be used wherein a bypass pipeline containing a flow controlling solenoid valve is connected between the inlet line 17 to the indoor coil 2 and the outlet line 16 of the outdoor coil 12. The selective operation for a time period as discussed above of the solenoid valve in such a bypass pipeline would also be effective to redistribute the pressure across the compressor 6. Thus, the novel method and system of the present invention equalizes the refrigerant pressure across the compressor 6 before starting the compressor to eliminate the need for a so-called "hard start kit". It should be noted that as previously stated the timing function provided by the timer and thermostat controller 26 may be effected by a suitable program in a microprocessor which is used to control the refrigeration system. Accordingly, it may be seen that there has been provided, in accordance with the present invention, a method for controlling a refrigeration system for reducing cycling losses and a refrigeration system using this method.

The embodiments of the present invention in which an exclusive property or privilege is claimed are defined as follows:

1. A method for controlling a refrigeration system having an indoor coil, an indoor coil fan, an outdoor coil, an outdoor coil fan, a refrigerant line between one end of the indoor coil and one end of the outdoor coil, a compressor means and a reversing valve connecting a compressor means between the other end of the indoor coil and the other end of the outdoor coil including the steps of operating the reversing valve to a state opposite to the one representative of the operating condition of the refrigeration system for a predetermined period of time starting prior to an energization of the compressor means and ending after the energization of the means which period of time is sufficiently short to minimize a differential pressure across the compressor means without allowing a redistribution of a liquid refrigerant in the refrigeration system and restoring the reversing valve to a state needed for the operating condition of the refrigeration system at the end of the period of time while continuing the energization of the compressor means.

2. A method as set forth in claim 1 wherein the period of time is approximately one second.

3. A refrigeration system comprising an indoor coil, an indoor coil fan, an outdoor coil, an outdoor coil fan, a refrigerant line connecting one end of said indoor coil to one end of said outdoor coil, compressor means, a reversing valve connecting said compressor means between the other end of said indoor coil and the other end of said outdoor coil and controller means for operating said valve, said indoor fan, said outdoor fan and said compressor means in a fixed sequence which includes operating the reversing valve to a state opposite to the one representative of the operating condition of the refrigeration system for a predetermined period of time starting prior to an energization of said compressor means and ending after the energization of said compressor means which period of time is sufficiently short to minimize a differential pressure across said compressor means without redistributing a liquid refrigerant in the refrigeration system, restoring the reversing valve to a state needed for the operating condition of the refrigeration system at the end of the period of time while continuing the energization of said compressor means.

4. A system as set forth in claim 3 wherein said time period is approximately one second.

5. A system as set forth in claim 3 wherein said indoor coil is an evaporator and said outdoor coil is a condenser.

6. A system as set forth in claim 3 wherein said indoor coil is a condenser and said outdoor coil is an evaporator.

7. A method for controlling a refrigeration system having a compressor means including an inlet port and an outlet port including the steps of selectively introducing a flow path between the outlet port and a low pressure point in the refrigeration system for a predetermined period of time starting prior to an energization of the compressor means and ending after an energization of the compressor means which period of time is sufficiently short to minimize a differential pressure across said compressor means without redistributing a liquid refrigerant in the refrigeration system.

8. A method as set forth in claim 7 wherein the time period is approximately one second.

9. A method as set forth in claim 7 and including the further step of continuing the energization of the compressor means after the end of the time period for a desired cycle of operation.

10. A refrigeration system comprising an indoor coil, an outdoor coil, a refrigerant line connecting one end of said indoor coil to one end of said outdoor coil, compressor means connected between the other end of said indoor coil and the other end of said outdoor coil, said compressor means having a high pressure outlet port, selectively operable flow path means connected between said outlet port and a low pressure point in the refrigeration system and controller means for operating said flow path means to induce a flow path between the outlet port and the low pressure point for a predetermined period of time starting prior to an energization of said compressor means and ending after the energization of said compressor means which period of time is sufficiently short to minimize a differential pressure across said compressor means without redistributing a liquid refrigerant in the refrigeration system and for energizing said compressor means for a desired cycle of operation.

11. A system as set forth in claim 10 wherein said time period is approximately one second.

12. A system as set forth in claim 10 wherein said flow path means includes a solenoid valve means arranged to be operated by said controller means.

* * * * *